US005199656A

United States Patent [19]

Szegvari et al.

[11] Patent Number: 5,199,656

[45] Date of Patent: * Apr. 6, 1993

[54] CONTINUOUS WET GRINDING SYSTEM

[75] Inventors: Arno Szegvari; Margaret Y. Szegvari, both of Akron; Richard A. Wochele, Brunswick, all of Ohio

[73] Assignee: Union Process, Inc., Akron, Ohio

[ * ] Notice: The portion of the term of this patent subsequent to Jan. 14, 2009 has been disclaimed.

[21] Appl. No.: 769,957

[22] Filed: Oct. 1, 1991

Related U.S. Application Data

[63] Continuation-in-part of Ser. No. 597,540, Oct. 15, 1990, Pat. No. 5,080,293.

[51] Int. Cl.[5] ..... B02C 17/16

[52] U.S. Cl. ..... 241/171; 241/172

[58] Field of Search ..... 241/171, 172, 46.17; 366/293, 294, 343

[56] References Cited

U.S. PATENT DOCUMENTS

| | | | |
|---|---|---|---|
| 3,215,353 | 11/1965 | Goeser | 241/15 |
| 3,450,356 | 6/1969 | Szegvari | 241/172 |
| 3,601,322 | 8/1971 | Szegvari | 241/46 |
| 3,770,214 | 11/1973 | Gabor | 241/42 |
| 3,927,838 | 12/1975 | Soloviev et al. | 241/46.15 |
| 4,244,531 | 1/1981 | Szegvari | 241/172 |
| 4,739,938 | 4/1988 | Ishikawa et al. | 241/171 |
| 4,850,541 | 7/1989 | Hagy | 241/171 |

FOREIGN PATENT DOCUMENTS

| | | | |
|---|---|---|---|
| 1216078 | 5/1966 | Fed. Rep. of Germany | 241/172 |
| WO90/07378 | 7/1990 | PCT Int'l Appl. | 241/172 |
| 995868 | 2/1983 | U.S.S.R. | 241/172 |

OTHER PUBLICATIONS

*Laboratory Attritors*, Union Process, ©1988.
*Production Attritors*, Union Process ©1989.
*HSF Batch Bead Mill*, Union Process ©1989.
*Turbamill TM*, Union Process, ©1988.

*Primary Examiner*—Douglas D. Watts
*Attorney, Agent, or Firm*—Reese Taylor

[57] ABSTRACT

A continuous grinding system for comminuting material in a liquid includes a grinding vessel and a rotating shaft carrying one or more mixing arms disposed within the vessel. A funnel-shaped housing and a cylindrical extension project into the vessel and the rotating shaft extends through the housing and the extension with the mixing arms being disposed beneath the extension. The rotating shaft also carries one or more radially projecting, angled impeller blades which are disposed within the extension. The blades may engage the extension in which event the extension may be separate from the housing or may terminate short of the inner wall of the extension in which event the extension may be secured to the housing. The cylindrical extension in a modified form of the invention extends into the housing a distance equalling from about 10% to about 75% of the depth thereof and preferably from about 50% to about 55%.

26 Claims, 6 Drawing Sheets

CONTINUOUS WET GRINDING SYSTEM

RELATED PATENT APPLICATIONS

This application is a continuation-in-part of Applicants' earlier filed application Ser. No. 597,540, filed Oct. 15, 1990 and now U.S. Pat. No. 5,080,293.

BACKGROUND OF THE INVENTION

This invention relates in general to comminution apparatus and relates in particular to an apparatus for comminuting or fine grinding material in a continuous fashion using liquid.

DESCRIPTION OF THE PRIOR ART

The prior art includes various methods and apparatus for wet grinding of particulate solids and also includes various methods and apparatus for doing such grinding in a batch method. An example can be seen in Hagy U.S. Pat. No. 4,850,541 which discloses a stirred ball mill which includes means for product recirculation to grind material to micron size range.

In general, it is recognized that it is often necessary and desirable to convert particles of materials from a larger size to a relatively smaller size for various end uses. This is often accomplished by mixing the solid particulate material with a liquid, such as water, and using grinding media, in cooperation with mechanical grinding or mixing arms, to cause the reduction of the size of the particles.

Examples of the types of materials ground in this fashion would be coal, quicklime and various other minerals.

For example, in lime-based flue gas desulfurization processes, it is necessary that the lime reagent be slaked at the point of use in order to maximize economy of operation. In this process, the lime is mixed with a controlled quantity of water to yield a suspension of extremely fine calcium hydroxide crystals in water.

The slaking process essentially involves the hydration of lime to form calcium hydroxide in the presence of excess water by an exothermic reaction. While details of this process are not overly relevant to the present invention, suffice it to say that the desired result is to suspend extremely fine calcium hydroxide particles in water. The small particle size is very important since it enhances the reaction time.

It is also desirable to have one system which can both slake the material and degrit it in one operation. Degritting is desirable because the grit material tends to be non-reactive and causes excess downstream equipment wear.

One of the difficulties encountered in operations of this type is that the material has a tendency to clog or cake, and also that some overflow problems are created. Of course, the clogging or caking reduces the efficiency of what is intended to be a continuous, efficient operation.

Also, in attempts to arrive at a satisfactory system, the use of a vertically oriented screw to perform the grinding operation has been only partially successful. One problem is that the screw forms a vortex and only limited amounts of the slurry gets into this vortex. Unfortunately, only the most viscous portion gets into the vortex and, since this includes the particles which have already been most thoroughly comminuted, there is a lack of efficiency in the grinding operation. That makes it necessary to run the material longer in order to achieve full grinding which increases power consumption and the heat which then requires the use of cooling means.

While it might be possible to employ a continuous horizontal system for fine grinding, several additional problems are created when such mills are used for the purposes of this invention. For example, the high tip speeds create excessive heat which must be compensated for. These systems also have sealing problems, excessive wear rates and utilize such small media that they require a slurry of very fine particles. Additionally, the particles generally only pass through these systems once, by design, so that sedimentation principles cannot be utilized to the detriment of the finished product.

Accordingly, it is believed that it is desirable to provide a continuous grinding system, and apparatus for use in such a system, for comminuting material in a liquid at low cost and with efficient operation.

SUMMARY OF THE INVENTION

It is a principal object of the invention to provide a continuous wet grinding system with a grinding vessel connected to a source of liquid and material and including a unique grinding apparatus which insures effective comminuting of the material, effective control of particle size and continuous flow of the slurry created thereby.

In furtherance of the object of the invention, it has been found that the basic comminuting apparatus can achieve an efficient and effective comminuting of the particles and flow of the slurry by providing a cylindrical grinding vessel which carries a generally funnel-shaped housing on its top end and a rotating shaft projecting into its interior. The shaft has a plurality of radially extending mixing arms and, above the arms, carries impeller blades encased in a cylindrical sleeve which improve the required pumping action and assure proper flow and mixing and grinding of the material.

It has been found that such a system can optionally be provided with a holding tank which includes a low speed mixer so that the material from the comminuting vessel itself can be passed into this low speed mixer and then out through a filtering media. The holding tank, it has been found, can be provided with discharge means adjacent its bottom with those discharge means connected to a pump so that coarse material, which does not get fully ground and will not pass through the screening, can be recycled back into the basic comminuting apparatus for further grinding.

It has also been found that improved circulation can be obtained by modifying the mixing arms so that they are bevelled or notched to improve both downward and upward flow.

Accordingly, production of an improved continuous grinding system for comminuting material in a liquid becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
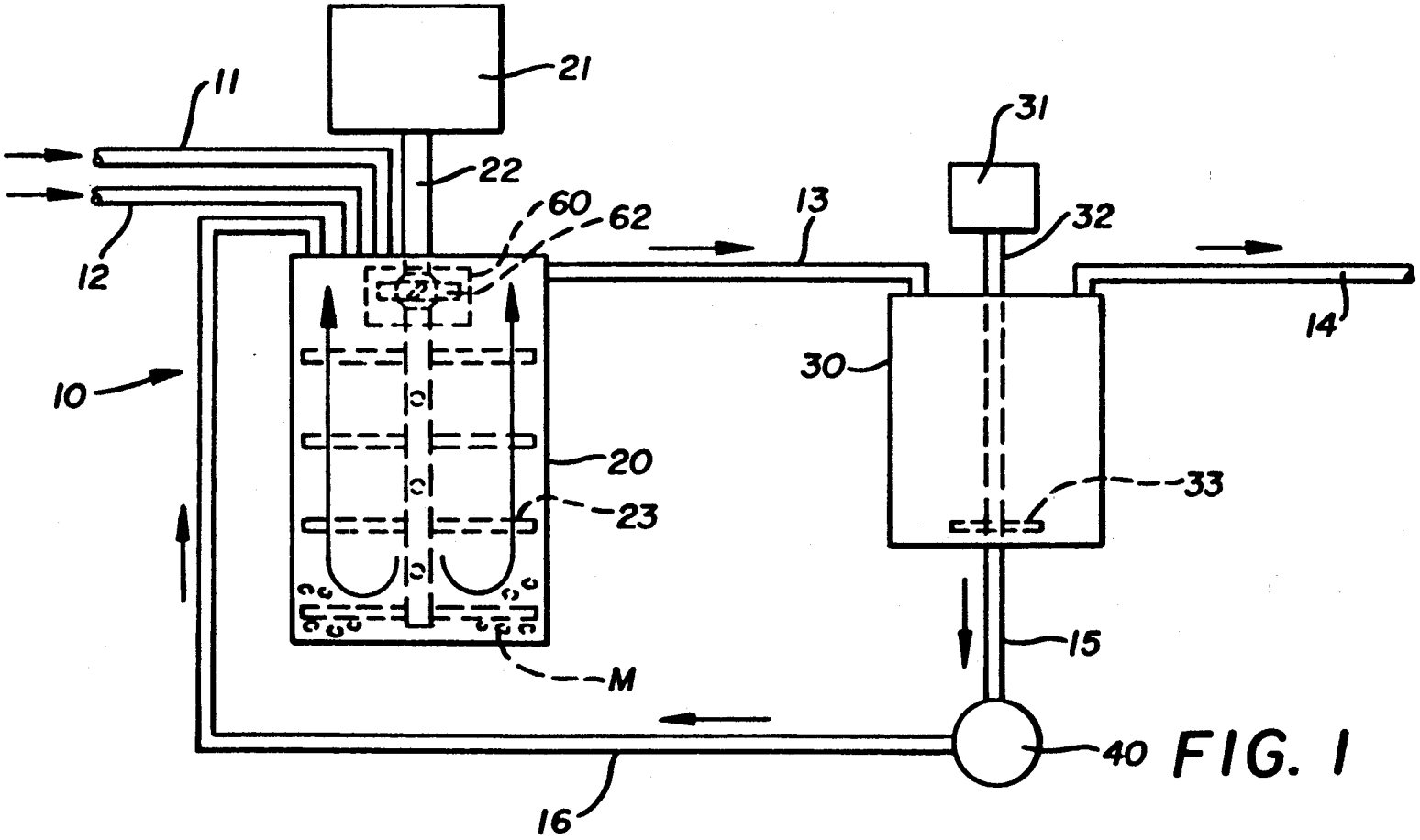
FIG. 1 is a schematic view of the overall system of the invention.

Referring first to FIG. 1, it will be noted that FIG. 1 is a schematic view showing the continuous, wet grinding system of the present invention as well as an additional embodiment thereof.

This system is generally indicated by the numeral 10 and includes, as its principal components, the comminuting vessel 20, the holding tank 30 and a pump 40. It will be noted that supply lines 11 and 12 lead into the comminuting vessel 20, and it is understood that the supply line 11 would be intended to supply the material to be ground, while supply line 12 would be intended to supply the liquid, such as water, which will go to form the slurry. The source of the particulate material and the liquid are not shown being well known to those of ordinary skill in this art.

It will also be noted that discharge line 13 leads out of the vessel 20. In the basic embodiment of the system, which will be described first, that line will lead to a storage tank (not shown), while in the later described embodiment it will lead to holding tank 30.

Still referring to FIG. 1 of the drawings, it will be seen that a motor 21 is mounted above the comminuting vessel 20 and has a rotating shaft 22 projecting therefrom and extending into the interior of the vessel 20.

The shaft 22 has radially projecting mixing arms 23,23 disposed along its longitudinal axis and extending toward the wall of the vessel 20. As illustrated, these arms 23,23 are arranged at approximately ninety degrees (90°) about shaft 22, although their angular relationship could be varied if desired. Furthermore, the precise number of arms 23,23 may be varied depending upon the size of the unit and the material involved.

It will be understood that comminuting media M will be received within the vessel 20 and that rotation of the shaft 22 will cause rotation of the arms 23 and create a comminuting movement wherein the media and the slurry of liquid and particulate material will be mixed together so that the particulate material will be ground in known fashion. The nature and size of the comminuting media will vary depending on the particulate material being ground with it being known to use such materials as carbon steel, stainless steel, chrome steel, tungsten carbide or ceramic type balls ranging generally from 3/16 of an inch to ½ of an inch in diameter. It will be appreciated that the materials and sizes set forth herein are illustrative only and the present invention is not intended to be so limited.

Still referring to FIG. 1, it will also be noted that one or more impeller arms 62 are received within the sleeve 60 and secured to shaft 22 to further facilitate the full mixing and movement of the material, as will be described in greater detail below.

Figure 2:
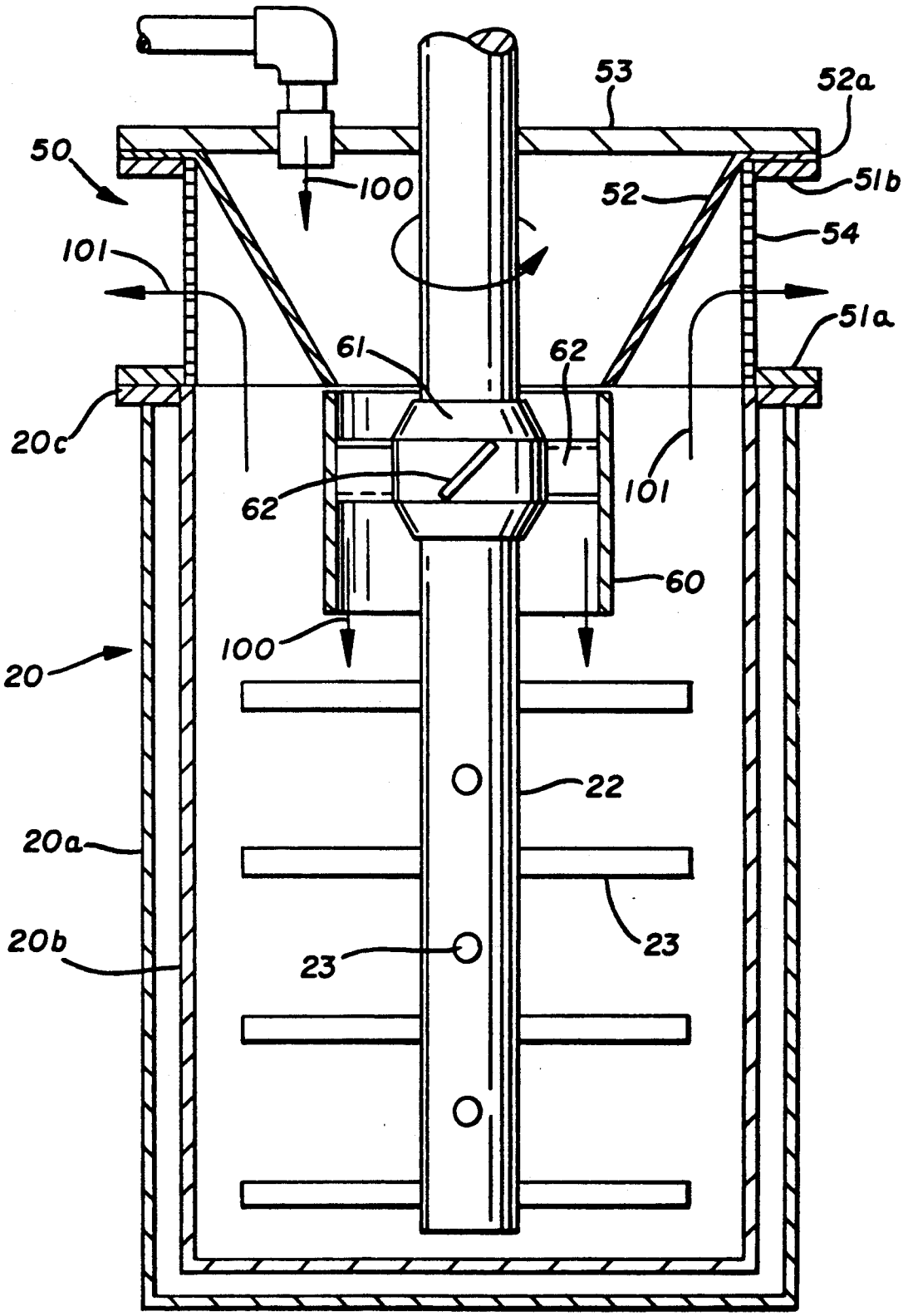
FIG. 2 is a sectional elevational view of one form of the improved grinding vessel.

Turning next then to FIG. 2 for a detailed description of the comminuting vessel 20, it will be seen that the vessel is illustrated as a jacketed member having a double wall structure indicated by 20*a* and 20*b*. However, it should be noted that the relatively low temperatures generated by the present invention may make it possible to eliminate the jacketed construction.

Adjacent the top of the comminuting vessel 20 is an annular flange 20*c* which can be integral with the wall of the vessel or welded or otherwise secured thereto, as desired. This flange 20*c* is intended to support a cylindrical housing 50 which has a complementary flange 51*a* which, in turn, can be secured to the flange 20*c* by any suitable means. Received on top of and extending into the housing 50 is a generally funnel-shaped housing 52 which has its own annular flange 52*a* which is disposed on top of the upper flange 51*b* of the cylindrical housing 50.

A suitably apertured top plate 53 is then secured on top of flange 52*a* of generally funnel-shaped housing 52 and again, these flanges can be secured together in any desired fashion. The top plate 53, as noted, has suitable apertures for supply lines 11 and 12 and discharge line 13 as well as shaft 22. It will also be noted that a filter 54 is carried by the wall of cylindrical housing 50.

In the form of the invention illustrated in FIG. 2 of the drawings, a rotating shaft 22, which is secured to the motor 21 (see FIG. 1) and driven thereby, projects into the interior of the vessel 20. The one or more radially extending mixing arms 23,23 are attached to the shaft 22 and project radially therefrom, as previously described. The bed of media M is received within the vessel 20 and, of course, will be agitated by these arms 23,23 upon rotation of shaft 22, as will the slurry formed by the liquid and the material to be ground.

Still referring to FIG. 2 of the drawings, it will be noted that one or more impeller blades 62 project from a fitting 61 which is secured to shaft 22. These blades 62,62 are generally flat and blade-like and are disposed at an angle with respect to a horizontal plane, as can clearly be seen in FIG. 2 of drawings.

In the form of the invention illustrated in FIG. 2 of the drawings, a cylindrical sleeve 60 is disposed around the blades 62, and the arms have a length such that they engage the inner wall of sleeve 60. It will be noted that the cylindrical sleeve 60 in FIG. 2 is not connected to the bottom of generally funnel-shaped housing 52 and, therefore, rotation of the shaft 22 will rotate the blades 62,62 and the cylindrical sleeve 60 itself. In operation, of course, the slurry will flow into the generally funnel-shaped member 52, pass through the impeller blades 62,62 in the direction of the arrow 100, as indicated, and down into the body of the vessel 20 where it will be mixed and fully ground and then passed out through the filter 54 in the direction of arrow 101 and into discharge line 13.

Figure 3:
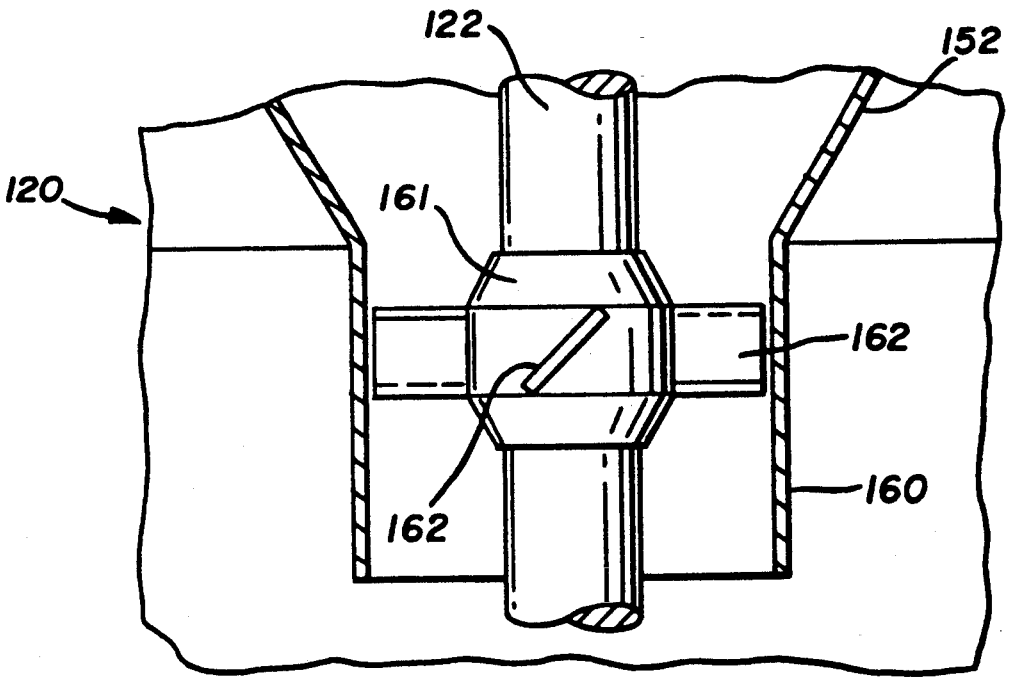
FIG. 3 is a partial elevational view showing a modified form of the improved comminuting apparatus.

FIG. 3 illustrates a modified form of the invention in which the comminuting vessel 120 carries a similar generally funnel-shaped member 152 and rotating shaft 122 with impeller blades 162,162 and mixing arms (not shown). In this form of the invention, however, the length of the impeller blades is such that they do not reach to the interior wall of the sleeve 160 and the sleeve is secured to the bottom of the funnel-shaped housing 152. Here, the rotation of shaft 122 will rotate only the blades 162,162 and not the sleeve 160. This form of the invention is generally thought acceptable in smaller installations wherein the impeller blades 162,162 themselves will create sufficient pumping action to assure the desired flow and it is not necessary to rotate the sleeve 160. It also has the advantage of eliminating any excess turbulence for the material moving upwardly on the outside of the sleeve which might be caused by rotation of the sleeve itself.

In operation of the basic form of the invention, that is without the use of the holding tank 30, the liquid and material to be ground are injected into the comminuting vessel 20 through supply lines 11 and 12 passing into the generally funnel-shaped housing 50 and through cylindrical sleeve 60.

As motor 21 drives shaft 22, mixing arms 23,23 agitate the grinding media M which acts on the slurry to grind the particulate material in generally known fashion. However, the action of shaft 22 creates a vortex around the shaft and previously only the most viscous portion of the slurry will pass into this vortex for continuous circulation and grinding. Also, when new material, which is a mixture of water and solids, which is not premixed, is fed into the vessel, the normal tendency is for the material to be forced to the outside. Since it is desirable to force the material through as long a path as possible through the grinding media M, it is desirable to counteract this tendency. Therefore, the action of the angled impeller blades 62,62 or 162,162 provides a pumping effect so that substantially all of the material is forced into the vortex and through the entire depth of the shaft.

As the material is continuously circulated, the slurry is also forced through the screen 54, which has the desired mesh size, and out through discharge line 13 with oversized particles remaining in the vessel 20 until reduced to a size suitable for passing through screen 54.

In some situations, it may be desirable to employ a holding tank. In that regard, in those situations, it is not desirable to provide too fine a mesh in screen 54 since the slurry exits the tank under force of gravity and there is a danger of plugging of the screen with the consequent need to remove and clean it. On the other hand, if the mesh is too large, there is a danger that oversized particles will get through, thereby adversely affecting the characteristics of the end product. Therefore, FIG. 1 while illustrating the basic concept of the invention, also illustrates a modified embodiment utilizing holding tank 30 whereby such larger particles are recirculated and again subjected to grinding to reduce their size.

Thus, FIG. 1 also shows discharge line 13 leading from the comminuting vessel 20 to the holding tank 30. It will be understood that, in most situations, the holding tank 30 may not be necessary, assuming that full and complete grinding of the material M to the desired size is achieved in the vessel 20. As noted, in the event it is not, however, the holding tank 30 will serve the purpose of assuring that complete grinding of all of the material is accomplished.

To that end, the discharge line 13 is shown leading from the comminuting vessel 20 into the tank 30 and is in communication with screen 54. This holding tank 30 carries a low speed mixer which includes a motor 31 and a rotating shaft 32 with one or more mixing arms 33 disposed on the rotating shaft 32. A second discharge line 14 leads from the holding tank 30 and is intended to discharge the material which will pass through a filter or screen of suitable mesh specification so that the material which meets the specification can pass out and to whatever collecting mechanism is desired. That is, as the slurry is further mixed in holding tank 30, that which has sufficiently fine particles can exit through the screen and second discharge line 14.

A return line 15 also leads from the bottom of the holding tank 30 and is intended to receive coarse material which will settle at the bottom of the holding tank 30. In that regard, coarse material would be that which could not pass through the screen into second discharge line 14. This material passes from return line 15 through a pump 40 and then through second return line 16 and back into the comminuting vessel 20 for further grinding. At that point, the oversized particles are simply reinserted into comminuting vessel 20 and added to the slurry for further grinding. In this way, it is believed possible to attain a result wherein the particulate material is nearly one hundred percent (100%) less than the predetermined mesh size.

In that regard, the basic operation of the comminuting vessel 20 and its associated components, such as rotating shaft 22, mixing arms 23,23 and blades 62,62, are as described above in this embodiment of the invention.

It also will be appreciated that either of the versions of the invention illustrated in FIGS. 2 and 3 can be used in the system which includes or excludes the holding tank 30.

Figure 4:
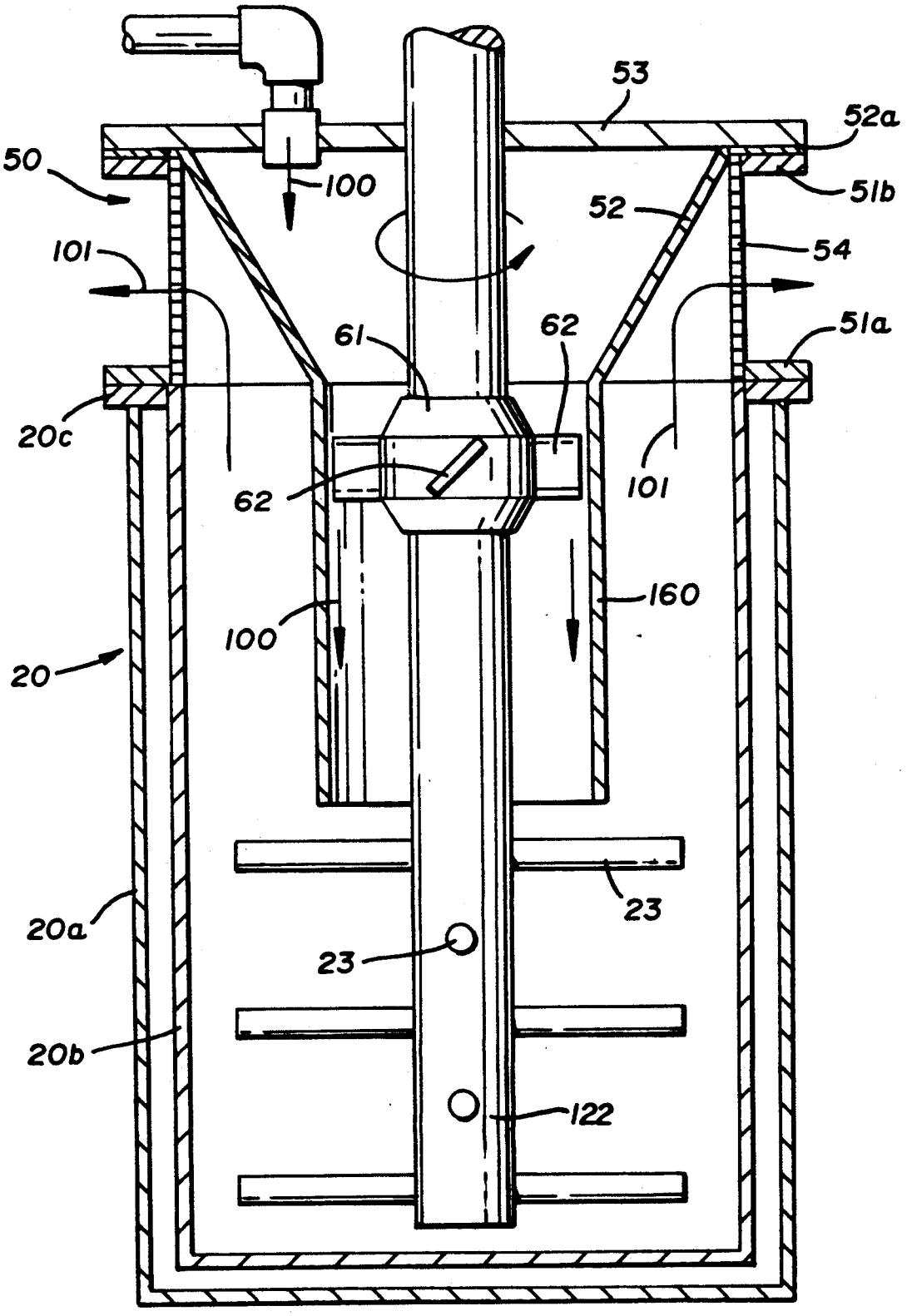
FIG. 4 is an elevational view, partially in section, showing a further modified form of the invention.
Figure 5:
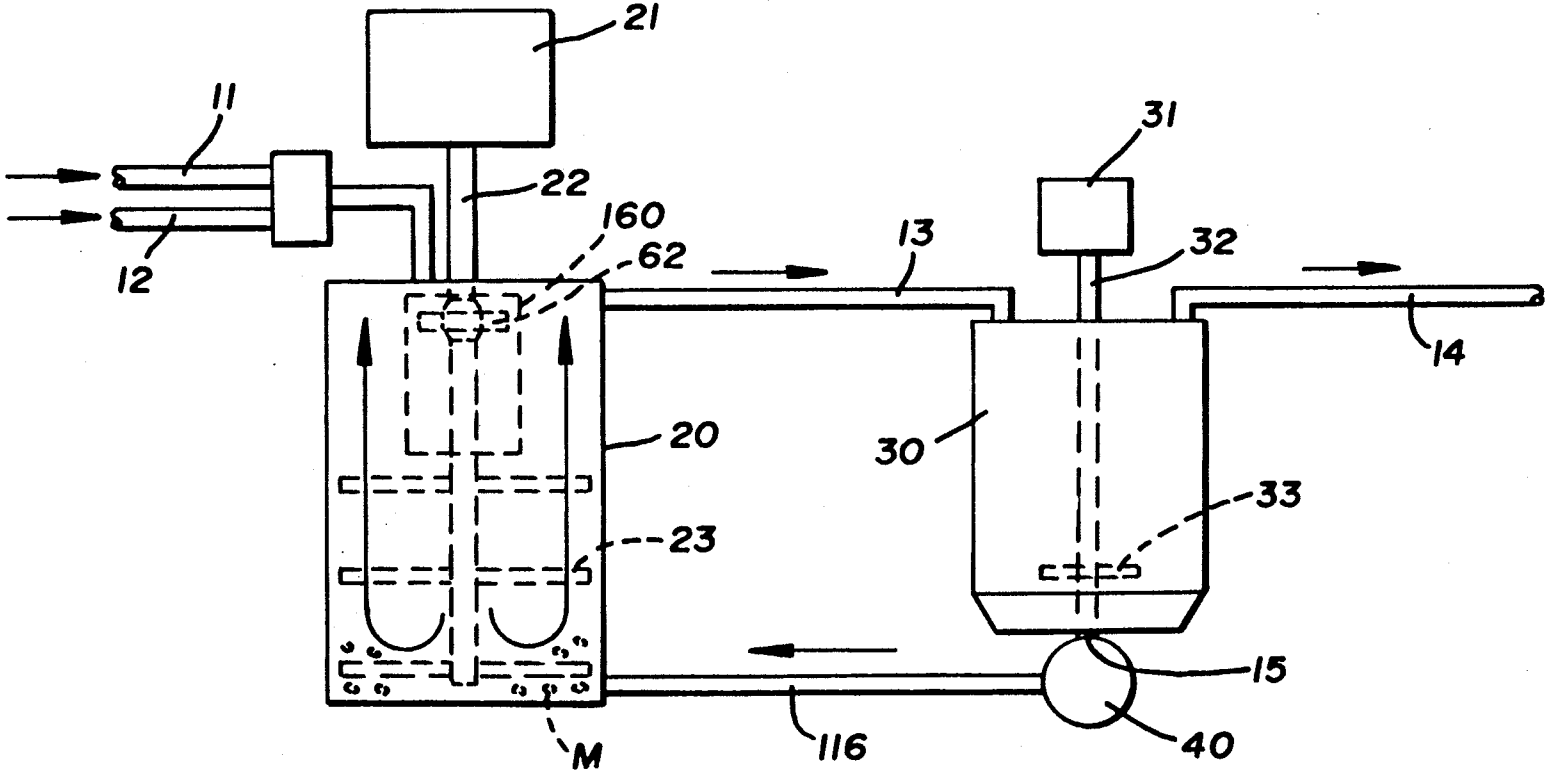
FIG. 5 is a schematic view of a modified form of the overall system of the invention.

FIGS. 4 and 5 illustrate a further embodiment of the invention wherein like elements are numbered as in FIGS. 1 through 3 and modified elements are numbered in the one hundred range.

In some instances, it has been found that improved results may be obtained by the modifications of FIGS. 4 and 5. Thus, it will be seen in FIG. 4 that sleeve 160 is elongated in comparison with sleeve 60 of FIGS. 2 and 3. This provides a greater area about the sleeve 160 and between it the inner wall 20*b* of the vessel 20 which area is insulated from the turbulence created by the impeller blades 62 and mixing arms 23. Inasmuch as the object in this area is to facilitate upward flow of fine particles only, the lack of turbulence is a desirable characteristic.

Additionally, an excess of turbulence in this area increases the probability that coarse material will be discharged through discharge line 13.

In practice, it has been found that extending the sleeve into the vessel from 10% to 75% of the depth thereof achieves this advantage with the optimum being achieved when the sleeve extends between 50% and 55% of the vessel depth.

FIG. 5 also illustrates a modification of the system which can be employed when holding tank 30 is employed. It will be seen that, in contrast to FIG. 1 of the drawings, return line 116 leads to the bottom of vessel 20 rather than to the top. This causes the coarse material which has settled to the tapered bottom of holding tank 30 to be delivered directly to the agitation area for more efficient operation.

Furthermore, in some instances, it may be desirable to add additional liquid at the bottom of the vessel 20 through line 112 shown in FIGS. 1 and 5 for improved mixing. Such an addition may, depending upon the requirements of the particular material, be employed either in the system illustrated in FIG. 1 where the recirculated material is injected in the top of vessel 20 or in FIG. 5 where it is injected in the bottom.

Figure 6:
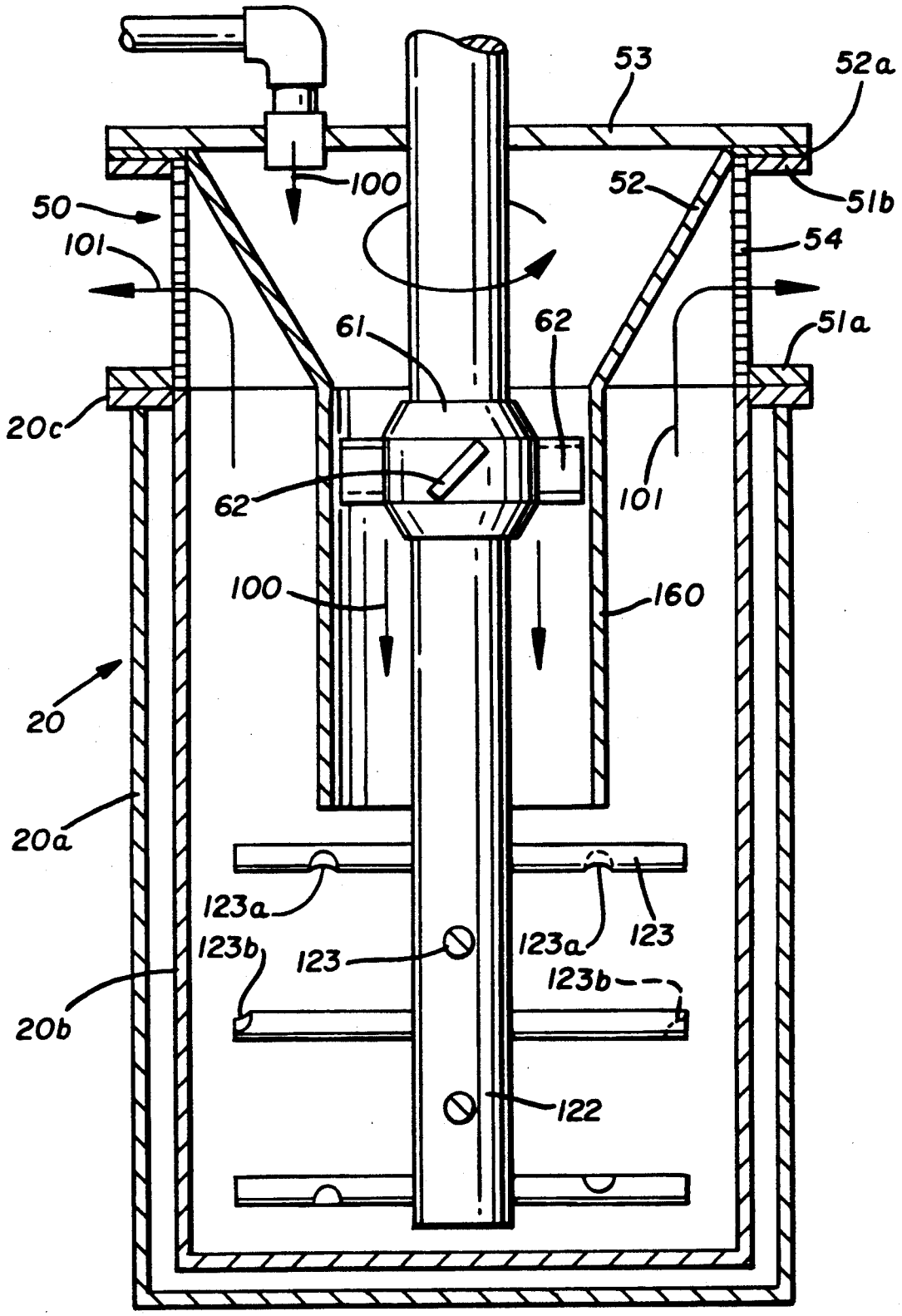
FIG. 6 is an elevational view, partially in section, showing a further modified form of the invention.

FIG. 6 illustrates a still further modified form of the invention wherein the mixing arms 123 have been modified to still further improve fluid flow. Thus, it will be seen that selected ones of the arms 123 are provided with bevels or radiused notches 123*a* disposed beneath sleeve 160 and between the projecting ends of the arms and the shaft 122 so as to augment down flow of the material in the direction of arrow 100.

Other ones of the arms 123 have bevels or notches 123*b* at their projecting ends beyond the plane of the sleeve extended to augment up flow of the material in the direction of arrow 101. It will be seen that, due to the configuration and disposition of the notches 123*a* and 123*b*, they will function somewhat as propellers to augment material flow.

It will be understood that either of the sleeve arrangements of FIGS. 2 or 3—fixed or rotatable—can be employed with the modifications of FIGS. 4 through 6.

While a full and complete description of the invention has been set forth in accordance with the dictates of the Patent Statutes, it should be understood that modifications can be resorted to without departing from the spirit hereof or the scope of the appended claims.

Thus, while lime slaking was mentioned above as one example of a process in which the present invention has great value, the inventive concept has uses in connection with many other processes and could be used, for example, as a wet pre-grinder or pre-mixer for many materials and processes such as desulferizing coal.

What is claimed is:

1. A continuous grinding system for comminuting material in a liquid, comprising:

a) a grinding vessel connected to a source of liquid and the material to be comminuted and having a depth dimension;

b) said grinding vessel including a rotating shaft extending into said vessel and at least one mixing arm attached to and projecting radially from said shaft;

c) a funnel-shaped housing disposed on the top of said vessel;

d) at least one impeller arm attached to and projecting radially from said shaft above said at least one mixing arm and below said generally funnel-shaped housing;

e) a cylindrical sleeve disposed in encircling relationship with said at least one impeller arm and extending into said grinding vessel a distance of from about 10% to about 75% of said depth dimension thereof; and f) filtering means disposed adjacent the top of said vessel.

2. The continuous grinding system of claim 1 further characterized by the fact that said cylindrical sleeve extends into said grinding vessel a distance of from about 50% to about 55% of said depth dimension thereof.

3. The continuous grinding system of claim 2 further characterized by the presence of a holding tank connected to said filtering means; said holding tank including a low speed mixer and discharge means adjacent its top and bottom ends.

4. The continuous grinding system of claim 3 further characterized by the presence of a pump; said pump interconnecting said holding tank and said grinding vessel and said discharge means adjacent said bottom end of said holding tank being connected to said pump and the bottom of said grinding vessel.

5. The continuous grinding system of claim 3 further characterized by the presence of liquid supply means communicating with said grinding vessel adjacent the bottom thereof.

6. The continuous grinding system of claim 1, 2 or 3 wherein said cylindrical sleeve is connected to said generally funnel-shaped housing; and said at least one impeller arm has its distal end spaced from said sleeve.

7. The continuous grinding system of claim 1, 2 or 3 wherein said cylindrical sleeve is axially spaced from said generally funnel-shaped housing; and said at least one impeller arm has its distal end in engagement with said sleeve.

8. The continuous grinding system of claim 1, 2 or 3 wherein said at least one impeller arm is a substantially elongate, flat, blade-like member and is disposed at an angle with respect to a horizontal plane.

9. The continuous grinding system of claim 6 wherein said at least one mixing arm has at least one notch in its peripheral surface disposed between its projecting end and said shaft so as to lie substantially below said sleeve.

10. The continuous grinding system of claim 7 wherein said at least one mixing arm has at least one notch in its peripheral surface disposed between its projecting end and said shaft so as to lie substantially below said sleeve.

11. The continuous grinding system of claim 6 wherein said at least one mixing arm has at least one notch in at least one of its projecting ends.

12. The continuous grinding system of claim 7 wherein said at least one mixing arm has at least one notch in at least one of its projecting ends.

13. The continuous grinding system of claim 6 wherein a plurality of mixing arms are provided; at least one of said mixing arms having at least one notch in its peripheral surface disposed between its projecting end and said shaft; and at least one of said mixing arms has at least one notch in at least one of its projecting ends.

14. The continuous grinding system of claim 7 wherein a plurality of mixing arms are provided; at least one of said mixing arms having at least one notch in its peripheral surface disposed between its projecting end and said shaft; and at least one of said mixing arms has at least one notch in at least one of its projecting ends.

15. A comminuting apparatus for grinding material in a liquid, comprising:

a) a cylindrical grinding vessel having a depth dimension;

b) a generally funnel-shaped housing disposed on the top of said vessel;

c) a rotating shaft extending through said generally funnel-shaped housing and into the interior of said vessel;

d) at least one mixing arm attached to and projecting radially from said shaft;

e) at least one impeller arm attached to and projecting radially from said shaft above said at least one mixing arm and below said generally funnel-shaped housing; and f) a cylindrical sleeve disposed in surrounding relationship with respect to said at least one impeller arm and extending into said grinding vessel a distance from about 10% to about 75% of said depth dimension thereof.

16. The comminuting apparatus of claim 15 wherein said cylindrical sleeve extends into said grinding vessel a distance of from about 50% to about 55% of said depth dimension thereof.

17. The comminuting apparatus of claim 15 or 16 wherein said cylindrical sleeve is attached to said generally funnel-shaped housing; and the projecting end of said at least one impeller arm is spaced from said sleeve.

18. The comminuting apparatus of claim 15 or 16 wherein said cylindrical sleeve is axially spaced from said generally funnel-shaped housing; and the projecting end of said at least one impeller arm is in engagement with said sleeve.

19. The comminuting apparatus of claim 15 or 16 wherein said at least one impeller arm is a substantially flat, blade-like member and is disposed at an angle with respect to a horizontal plane.

20. The continuous grinding system of claim 18 wherein said at least one mixing arm has at least one notch in its peripheral surface disposed between its projecting end and said shaft so as to lie substantially below said sleeve.

21. The continuous grinding system of claim 19 wherein said at least one mixing arm has at least one notch in its peripheral surface disposed between its projecting end and said shaft so as to lie substantially below said sleeve.

22. The continuous grinding system of claim 18 wherein said at least one mixing arm has at least one notch in at least one of its projecting ends.

23. The continuous grinding system of claim 19 wherein said at least one mixing arm has at least one notch in at least one of its projecting ends.

24. The continuous grinding system of claim 18 wherein a plurality of mixing arms are provided; at least one of said mixing arms having at least one notch in its peripheral surface disposed between its projecting end and said shaft; and at least one of said mixing arms has at least one notch in at least one of its projecting ends.

25. The continuous grinding system of claim 19 wherein a plurality of mixing arms are provided; at least one of said mixing arms having at least one notch in its peripheral surface disposed between its projecting end and said shaft; and at least one of said mixing arms has at least one notch in at least one of its projecting ends.

26. A comminuting apparatus for grinding material in a liquid, comprising:

a) a cylindrical grinding vessel having a depth dimension;

b) a generally funnel-shaped housing disposed on the top of said vessel;

c) a rotating shaft extending through said generally funnel-shaped housing and into the interior of said vessel;

d) a plurality of mixing arms attached to and projecting radially from said shaft;

e) at least one impeller arm attached to and projecting radially from said shaft above said plurality of mixing arms and below said generally funnel-shaped housing;

f) a cylindrical sleeve disposed in surrounding relationship with respect to said at least one impeller arm and extending into said grinding vessel;

g) at least one of said mixing arms having a notch in its peripheral surface between its projecting end and said shaft; and h) at least another of said mixing arms having a notch in at least one of its projecting ends.

* * * * *